United States Patent [19]

McCoy

[11] Patent Number: 4,516,295

[45] Date of Patent: May 14, 1985

[54] SECUREMENT MEANS

[76] Inventor: Donald G. McCoy, 69 Penfold Rd., Rosslyn Park, Australia, 5072

[21] Appl. No.: 464,515

[22] PCT Filed: May 27, 1982

[86] PCT No.: PCT/AU82/00084

§ 371 Date: Jan. 27, 1983

§ 102(e) Date: Jan. 27, 1983

[87] PCT Pub. No.: WO82/04235

PCT Pub. Date: Dec. 9, 1982

[30] Foreign Application Priority Data

May 27, 1981 [AU] Australia ..... PE9064

[51] Int. Cl.[3] ..... B63B 15/02; F16G 11/00

[52] U.S. Cl. ..... 24/136 R; 24/115 K; 24/122.6; 24/136 K; 114/39; 114/97

[58] Field of Search ..... 24/136 R, 136 K, 115 K, 24/115 M, 122.6, 352; 114/39, 97, 294

[56] References Cited

U.S. PATENT DOCUMENTS

| | | | |
|---|---|---|---|
| Re. 31,167 | 3/1983 | Schweitzer et al. | 114/97 |
| 1,526,789 | 2/1925 | Hutter | 24/136 K |
| 2,573,745 | 11/1951 | Wallenberg | 114/39 |
| 2,635,796 | 4/1953 | Davolt | 24/122.6 |
| 3,191,569 | 6/1965 | Coombe | 114/39 |
| 3,791,330 | 2/1974 | Haddad | 114/39 |
| 4,019,609 | 4/1977 | Wagner | 24/136 R |
| 4,136,414 | 1/1979 | Popkin | 114/39 |
| 4,311,107 | 1/1982 | Imre | 114/97 |

FOREIGN PATENT DOCUMENTS

| | | | |
|---|---|---|---|
| 2900908 | 7/1980 | Fed. Rep. of Germany | 114/97 |

*Primary Examiner*—Victor N. Sakran

[57] ABSTRACT

An apparatus (1) for attaching each end of a rope (12) to the boom of a sail board so that the rope (12) can be used by a rider with a "Hawaiian Harness" the apparatus (1) having in each case a frame (2) with a pliable member (3) held to the frame (2) and adapted to extend around the boom arranged so that with the frame (2) lying alongside the boom tension on the rope (12) will cause the frame (2) to tighten a gripping hold of the pliable member (3) on the boom. The apparatus provides for good retention of the rope position during periods of non-use and facilitates adjustment of its position during use by a sail board rider.

9 Claims, 5 Drawing Figures

SECUREMENT MEANS

Figure 1:
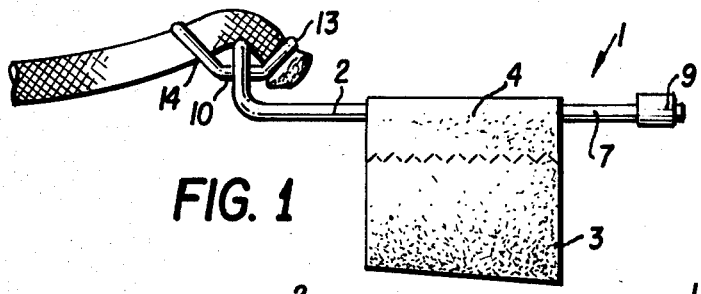

This invention relates to securement means having particular application with respect to holding of a rope with respect to a boom of a device now commonly known as a "wind surfer".

With a "wind surfer" there is included a boom which is held conventionally by a rider who can thereby hold a sail, in an effective orientation with respect to the wind and thereby effect movement of the "wind surfer" over the water.

It has been found preferable for more experienced riders to have some means by which the sail can be held without continual use of the hands and there has therefore developed a technique by which a rope is attached at spaced apart distances on the boom and the rider has secured to him a hook which is interconnected with the rope, this being conventionally referred to as a "Hawaiian Harness".

The problem to which this invention is directed is the difficulty of attachment of this rope to the boom.

While these following features will genreally be very well known to those familiar with this art, some reference to these may assist the reader not particularly familiar with this art.

The simplest method of all of attaching a rope to the boom would be to simply tie this at several spaced apart positions along the boom.

The problem here is that the type of material conventionally required to be used as rope will tend to tighten substantially with respect to any knots tied in it and further more it is essenitial from time to time to be able to alter the position of the location securement points of the rope with respect to the boom.

This comes about for instance by changes in the weather and therefore a different positioning of the holding point with respect to a forward to aft position of the sail and it therefore becomes essential to be able to shift the securement point of the rope from time to time.

Simply tying the rope makes it most difficult in practise to undo or to change position and in practise this has not been preferred.

It is a desirable feature that the length of rope be kept as short as reasonably possible and preferably held so that the rope will generally project outwardly from the boom to facilitate easy attachment to the hook attached to the rider.

Ideally, a securement arrangement should enable any securement to be readily releasable but otherwise able to positively hold with respect to the boom and at the same time in a preferred arrangement be capable of being placed on the boom without access to an open end of the boom.

Further to this, the securement arrangement should be such that it can be economically manufactured and as simple as can be possible to minimise any breakdown in operation.

Self evidently, the apparatus should be capable of being made in such a simple way from materials which are essentially non-corrosive.

The invention in one form can be said to reside in apparatus for attachment of each end of a rope to the wishbone boom of a sail board for use with a "Hawaiian Harness" the apparatus including a frame adapted to be locatable alongside the boom, and a pliable member adapted to engage around the boom and inter-engage with the frame member, and rope holding means on the frame and arranged to facilitate pulling of a rope attached thereto along the direction of elongation of the boom, the frame and the pliable member being so arranged and adapted to locate around a boom such that with such pulling, there can result a tightening of the pliable member about the boom and a tight gripping of the boom thereby.

The preferred arrangement includes the feature that the pliable member has two ends which engage with slidable freedom along the frame and by reason of the slidable attachment location, the tightening of the grip by the pliable member around a boom can thereby be effected.

Preferably, the frame includes two legs which are located in a converging relationship, one with respect to the other and these provide the slidable engagement means around which the ends of the pliable member can engage.

Preferably the legs are joined together at one end by releasable securable means such that they can be spread apart if required.

Preferably, the pliable member comprises a strap and this is adapted to engage around the boom by having at each end a loop through which each of the legs of the frame pass.

Preferably the means for holding the rope with respect to the frame are at an end opposite to that where the several legs are held with the releasably securable means.

Preferably the means providing for holding of the rope includes a medial member and two outer members these member located with relation to each other so as to hold a rope in a curved alignment over the medial member and such that a portion of the rope is located outermost from either of the two outer members.

The advantage of this holding arrangement is firstly that it is simple and economic but furthermore, if the boom together with this apparatus as is very possible in the sport of board sailing falls onto the board, the outermost material being rope at the least provides some softening of the impact and less possible damage to the material of the board.

Figure 2:
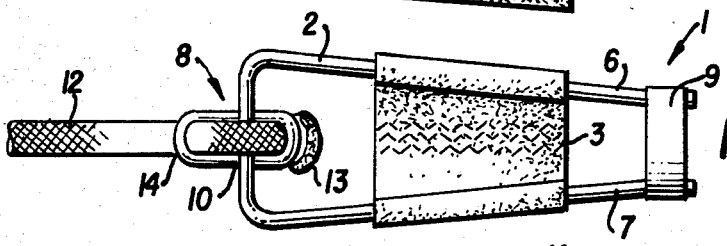
Figure 3:
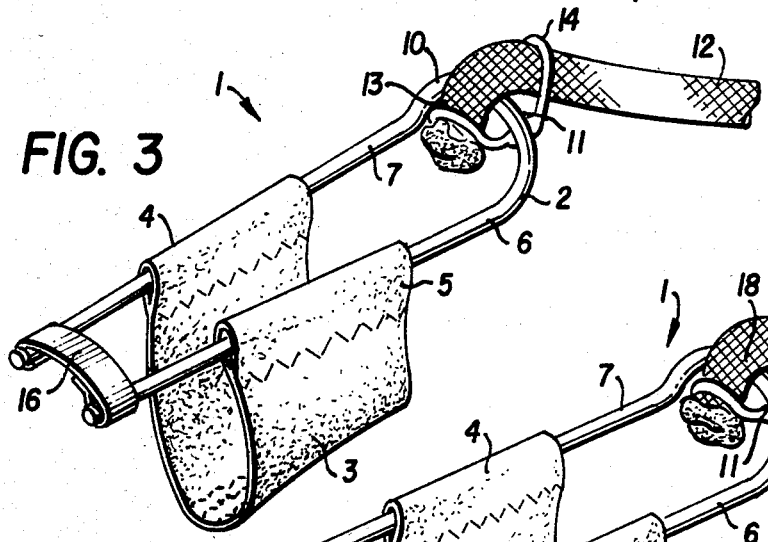
Figure 4:
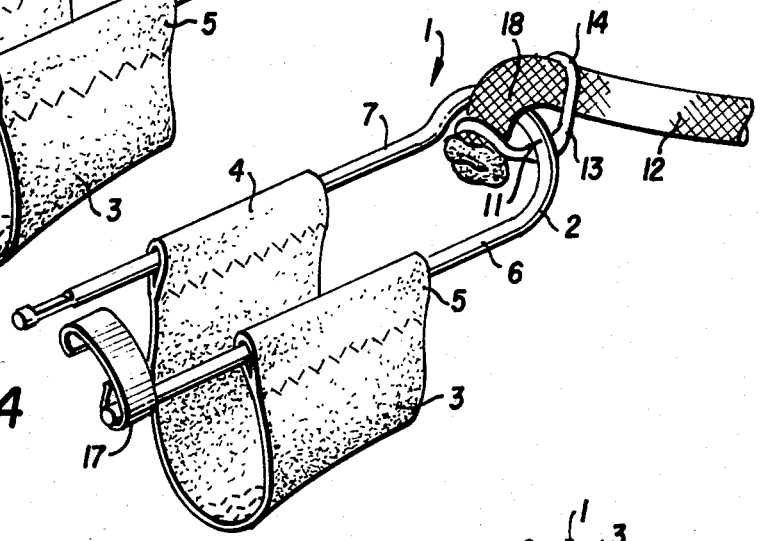
Figure 5:
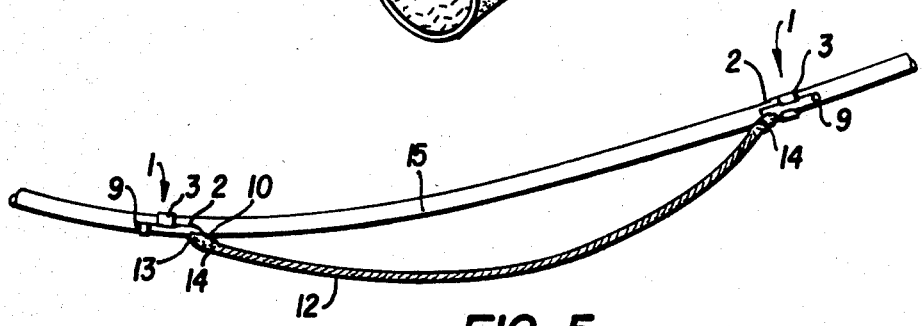

A better understanding of this invention will be gained with reference to the preferred embodiment which will now be described with the assistance of drawings in which FIG. 1 is a sail elevation of the apparatus holding one end of a rope in accord with the embodiment, FIG. 2 is a plan view of the same apparatus as in FIG. 1, FIG. 3 is a perspective view of the same apparatus as in FIGS. 1 and 2, FIG. 4 is a perspective view of the same apparatus as in FIGS. 1, 2 and 3 except that the legs are released, and FIG. 5 is a perspective view showing the way in which two of the pieces of apparatus can be attached in spaced apart location along the boom of a sail board, and provide support for a rope in a preferred location.

Referring in detail to the drawings, the apparatus 1 includes a frame 2 and a pliable member 3 constituted by a strap having at each end thereof a loop 4 and 5.

The frame 2 includes two legs 6 and 7 each of which in the embodiment comprise stainless steel rods which are located so as to generally be shaped one with respect to the other so that they converge from an end providing for rope holding means 8 to the end for providing for means 9 to hold the two ends together of the legs 6 and 7.

The shape of the frame can be easily discerned from the drawings but includes a shape substantially formed by bending of a wire or rod providing at the rope holding end 8 a raised portion 10 which provides thereby a medial rear support 11 for the rope end 12 the rope otherwise being held by outer members 13 and 14. The rope is additionally deformed by heat at its end.

The strap 3 is adpated by reason of its length and its pliable character and width to provide for firm gripping of the boom 15 especially when the strap is caused to slide toward the end 9.

The strap 3 has an inter-engaging relationship with the frame 2 by reason of the loops 4 and 5 encircling the legs 6 and 7.

The degree of inclination or convergence between the respective legs 6 and 7 is determined with reference to the cross-sectional shape and of course size of the boom 15 which will vary with respect to different manufacturers of booms for sail boards.

The frame 2 is generally elongated and has a lower most shape which is adapted to lie effectively along the elongate direction of the boom 15.

The location of the rope holding means and its arrangement is such as to facilitate the pulling of the frame 2 in a direction along the elongation direction of the boom 15 and hence causing a bringing together of the ends 4 and 5 so that as this remains in a surrounding and generally static position with respect to the boom 15, the ends 4 and 5 are pulled tighter together and hence the grip and securement of the whole assembly 1 is improved.

To change location it is a simple matter of pushing the frame 2 in an opposite direction feeding the ends 4 and 5 and then shifting both to a new position.

To locate the apparatus in a first instance on the boom of a wind surfer or sail board of any type it is necessary to provide for a freeing of the strap and this is best achieved by opening of a clip assembly 16 one end of which is rotatably secured to the leg 6 and the other end of which is adapted to ride over and engage the end of leg 7 with secure engagement.

In this way however, the strap can be located around the boom 15 with loop 4 being urged around and then located with the leg 7 passing there through.

The rope holding means 8 is adapted to provide that an outermost portion 18 will so project forward of any of the other portions of the frame for instance the outer members 13 and 14 that in the event that the sail of the sail board together with the boom should happen to impact against the surface of the board, it is the rope that will impact and not the metal frame.

This can in some instances mitigate possible damage.

It will now be seen that what has been proposed provides a very economically manufacturable article which can furthermore provide for means which can be easily loosened by holding of the frame 2 and urging this in the contra direction to the pulling direction of the rope and then relocating the apparatus relative to the boom 15.

Conversely however, a very important aspect of such an apparatus is that when it is located, it will not readily dislodge so that for instance when the rider is on the opposite side of the sail, it will still maintain its position ready for use when the rider is on an alternate tack.

The embodiment disclosed has shown itself to provide for these advantages.

It will be apparent however that at least in its broader concept, the invention need not be restricted to the specific performance or details described in relation to the preferred embodiment.

I claim:

1. Apparatus for releasable attachment at spaced apart distances of each end of a rope to a sail board wishbone boom for use with a "Hawaiian Harness", the apparatus comprising a frame adapted to be locatable alongside the boom, and a pliable member adapted to engage around the boom and inter-engage with the frame member, and rope holding means on the frame arranged to facilitate pulling of the frame by a rope attached thereto along the direction of elongation of the boom, the frame and pliable member being so arranged that such pulling can result in a tightening of the pliable member about the boom and tight gripping thereby of the boom whereas the apparatus can be released for relocation at another location along the boom by urging the frame in a direction contra to the pulling direction of the rope.

2. Apparatus as in claim 1 wherein the pliable member includes two ends each of which is slidably held with respect to the frame.

3. Apparatus as in claim 2 wherein the frame includes two legs arranged to converge one with respect to the other, and each end of the pliable member being retained with respect to the frame by slidable engagement each end with respect to a respective leg.

4. Apparatus as in claim 3 wherein the legs converge to a narrowest location at which there is provided releasable securement means.

5. Apparatus as in any one of claims 2–4 wherein the pliable member comprises a strap including a seam at each end providing a loop thereby through which each leg passes providing the inter-engaging relationship.

6. Apparatus according to any one of claims 1–4 wherein the frame includes a rope holding means including a medial member and two outer members these members being located so as to be able to hold a rope in a curved alignment over the medial member and such that a portion of the rope is located outermost from either of the two outer members.

7. A rope in combination with the boom of a sail board wherein the means holding each end of the rope comprise an apparatus in accordance with any of claims 1–4.

8. A rope in combination with the boom of a sail board wherein the means holding each end of the rope comprise an apparatus in accordance with claim 5.

9. A rope in combination with the boom of a sail board wherein the means holding each end of the rope comprise an apparatus in accordance with claim 6.

* * * * *